US006980931B1

(12) United States Patent
Reitano

(10) Patent No.: US 6,980,931 B1
(45) Date of Patent: Dec. 27, 2005

(54) SYSTEM AND METHOD FOR CONTROLLING COMPUTER PROCESSES BY MEANS OF BIOMETRIC DATA

(76) Inventor: Carmen T. Reitano, 192 N. End Blvd., Salisbury, MA (US) 01952

( * ) Notice: Subject to any disclaimer, the term of this patent is extended or adjusted under 35 U.S.C. 154(b) by 104 days.

(21) Appl. No.: 10/249,388

(22) Filed: Apr. 3, 2003

(51) Int. Cl.[7] ..... H04R 11/10

(52) U.S. Cl. ..... 702/189; 702/56; 381/405; 381/396

(58) Field of Search ..... 702/189, 19, 56, 702/57, 65, 75, 115, 182, 183, 64; 381/58, 381/59, 74, 332–335, 117, 119, 184, 185, 381/186, 396, 412, 398–402, 420, 426, 427, 381/417, 418, 413, 405, 424, 423; 704/270, 704/205, 246, 275, 276, 271, 207; 434/167, 434/168, 118, 236, 238, 256–258, 262, 275, 434/295, 301, 308; 600/300, 544, 545, 301, 600/306, 514, 587, 595; 73/570, 579, 645, 73/649, 262, 269, 274, 278, 279; 607/57, 607/55; 181/148, 157, 158, 161, 163, 168, 181/175

(56) References Cited

U.S. PATENT DOCUMENTS

| | | | | |
|---|---|---|---|---|
| 5,249,237 | A * | 9/1993 | Paddock | 381/405 |
| 5,539,861 | A * | 7/1996 | DeSimone | 704/234 |
| 5,847,333 | A * | 12/1998 | D'Hoogh | 181/171 |
| 6,151,571 | A * | 11/2000 | Pertrushin | 704/209 |
| 6,393,319 | B1 * | 5/2002 | Bock et al. | 607/2 |
| 6,402,520 | B1 * | 6/2002 | Freer | 434/236 |
| 6,411,723 | B1 * | 6/2002 | Lock et al. | 381/431 |
| 6,654,476 | B1 * | 11/2003 | Guenther | 381/407 |

OTHER PUBLICATIONS

Payne et al., BioMeditation, 1977 no month, BFI Inc., Chapters I-IX and Appendix.*

* cited by examiner

*Primary Examiner*—Hal Wachsman
(74) *Attorney, Agent, or Firm*—Mark P. White

(57) ABSTRACT

A signal isolation system includes an aeroisolator to couple output signals to an electronic device. The aeroisolator is made from two commercial miniature earphones, each having a ferro-magnetic diaphragm activated by a voice coil in proximity to a permanent magnet. The diaphragm is removed from one of the earphones, and the two earphones are then disposed in proximity to each other, with the diaphragm in proximity to the voice coil of each.

1 Claim, 9 Drawing Sheets

Fig. 4a - Prior Art

SYSTEM AND METHOD FOR CONTROLLING COMPUTER PROCESSES BY MEANS OF BIOMETRIC DATA

BACKGROUND OF INVENTION

Modern computers use a variety of means of inputting data, for a variety of purposes. A typical prior art computer system, as shown in FIG. 6, inputs data by means which include a keyboard 3, mouse 4, and joystick 5. Each of these is particularly oriented toward a particular type of input data.

The keyboard, for instance, is generally used to input text data, although the arrow keys, up-down keys, etc. can be used to navigate about a graphic display, as well as a text display. Some primitive graphic computer games used the keyboard in this fashion.

The mouse, on the other hand, provides an easy means to input control or navigation data, such as directing movement about a graphic screen by showing the current position of a cursor, and providing an easy and intuitive way to move the cursor in two dimensions. The mouse can also provide a means of inputting text data, such as selecting a text character from a menu of text characters, although the keyboard provides an easier, more straightforward text input.

As complexity of computer games has grown, other means of navigation and position input have become popular, such as the joystick 5. Patterned after the joystick used to control small aircraft, the joystick is a preferred alternative to the mouse for providing x–y information to the computer, with the position of a cursor as visual feedback.

A number of different types of computer processes use these navigational types of inputs. The most popular process, in terms of the number of users, is the computer game. A game, such as the FLIGHT SIMULATOR®, developed and sold by MICROSOFT®, is a typical such application, in which a mouse, or joystick, mimics the joystick of an actual aircraft.

However other processes also require directional or navigational control inputs. Virtual reality systems, used to control real processes, such as the handling of hazardous materials, use virtually the same technologies as computer games.

The present invention provides another class of inputs which can be used to control computer processes: biometric data. A graphic process using biometric data input can be used for a variety of purposes. These include simple, graphic display of biometric data display for bio-feedback purposes. For instance, it is well known that a person with high blood pressure can learn to control, influence, raise, or lower his blood pressure with the aid of a real-time blood-pressure display.

SUMMARY OF INVENTION

It is an object of the present invention to provide a system and method for inputting biometric data to a computer for input to a computer process. It is a specific object of the invention to provide such a system and method for input by relative biometric instruments to a computer.

In accordance with a first aspect of the invention, a system for controlling a computer process, hosted on a personal computer includes a sound card.

In accordance with a second aspect of the invention, the system includes one or more biometric measurement instruments, each producing one or more audio output signals whose frequency varies as a function of a biometric parameter measured.

In accordance with a third aspect of the invention, isolation means to couple the audio output signals to the sound card are provided.

In accordance with a fourth aspect of the invention, software is provided to measure the frequencies of the audio output signals and create a parameter proportional to each frequency.

In accordance with a fifth aspect of the invention, software is provided to couple the parameters to the computer process.

In accordance with a sixth aspect of the invention, one or more of the biometric measurement instruments are relative measurement instruments.

In accordance with a seventh aspect of the invention, an aeroisolator is included, which is made from two miniature audio earphones, each having a sensing coil, a ferromagnetic diaphragm which will vibrate in response to sound waves, and a permanent magnet in proximity to the sensing coil, wherein the two miniature audio earphones are affixed together after the ferromagnetic diaphragm of one has been removed, and with the ferromagnetic diaphragm of the other in close proximity to the sensing coil of the other.

In accordance with an eighth aspect of the invention, the aeroisolator includes a ferromagnetic diaphragm having two sides, a permanent magnet in proximity to the sensing coil, and two sensing elements, one disposed in proximity to either side of the ferromagnetic diaphragm.

In accordance with a ninth aspect of the invention, the sound card includes a DMA circuit, wherein the audio signal is sampled by the sound card creating a multiplicity of samples, each having an amplitude, and occurring at a different sample time, wherein the samples are written into a memory buffer by means of the DMA circuit.

In accordance with a tenth aspect of the invention, calculation of the frequency of the audio signal includes means to measure the zero crossing times in the memory buffer.

In accordance with an eleventh aspect of the invention, two or more biometric instruments are provided, each instrument producing a separate biometric output signal.

In accordance with a twelfth aspect of the invention, an audio mixer which combines the biometric output signals is included, which produces a single biometric output signal; and whereby the single biometric output signal is input to the audio card.

In accordance with a thirteen aspect of the invention, the biometric instrument outputs a signal in which audio outputs representing two or more biometric parameters is produced.

BRIEF DESCRIPTION OF DRAWINGS

These, and further features of the invention, may be better understood with reference to the accompanying specification and drawings depicting the preferred embodiment, in which:

FIG. 4*a* depicts a schematic view of a prior art relative biometric measurement instrument.

DETAILED DESCRIPTION

The current invention provides a new means for inputting control data to a computer, which can then be used to control a process running on the computer.

Figure 6:
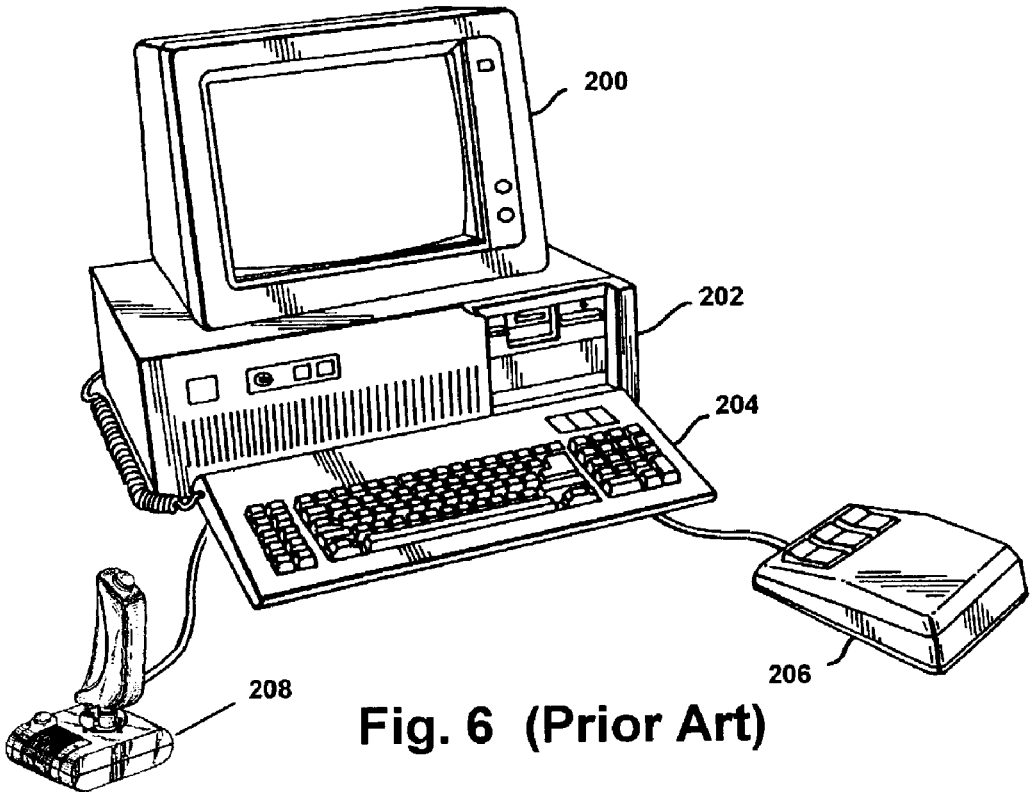
Fig. 6 (Prior Art)
FIG. 6 depicts a perspective view of a prior art computer with prior art input devices.

Referring first to FIG. 6, the prior art in computer input devices is well known to include the keyboard 204, the mouse 206, and the joystick 208. All of these input devices rely on physical movement on the part of the user to effect input by means of these devices.

The present invention provides for a new type of input, namely biometric input, as an input to the computer, which can be used to control computer processes in exactly the same way as the prior art devices.

Figure 1:
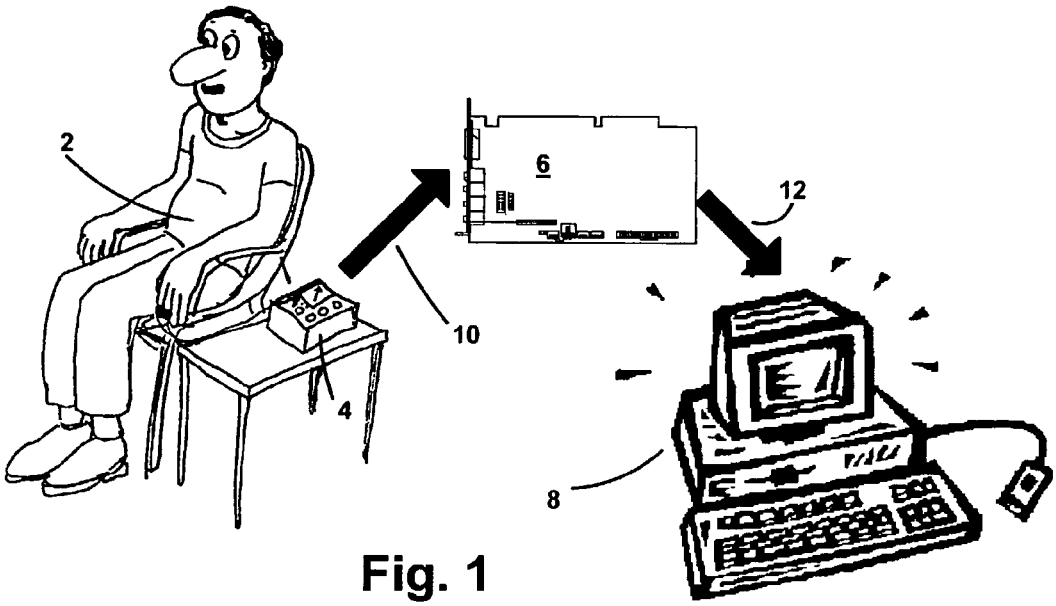
FIG. 1 depicts a fanciful view of the preferred embodiment of the present invention.

The present invention involves several components. Referring to FIG. 1, a user 2 is physically attached to a biometric device 4, by means of a sensor 3 attached to the user's finger. An electrical signal output from the biometric device is coupled to a sound card 6 in a personal computer 8 by means of an electronic connection 10 which provides ground isolation between the biometric device 4 and the sound card, so that noise associated with such transmissions is minimized. The sound card 6 is electrically connected to the computer by means of the computer bus 12. Although FIG. 1 shows the sound card external to the computer to demonstrate the components of the current invention, the sound card is typically mounted within the computer enclosure, in one of the "slots" typically provided for peripheral devices. Some computers provide a sound card integrated into the motherboard. Sound cards are also available as external devices, electrically connected to the computer via USB devices.

Figure 4B:
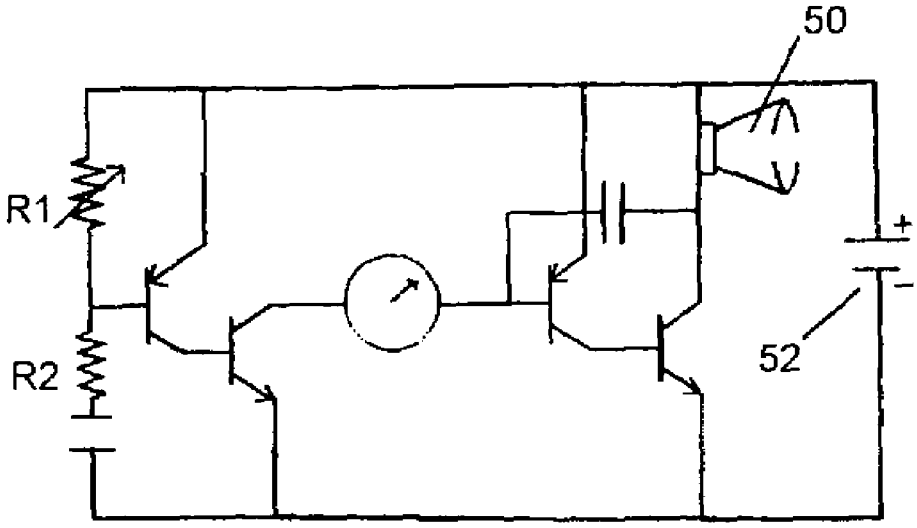
FIG. 4*b* depicts a schematic view of a relative biometric measurement instrument modified in accordance with the present invention.
Figure 4B:
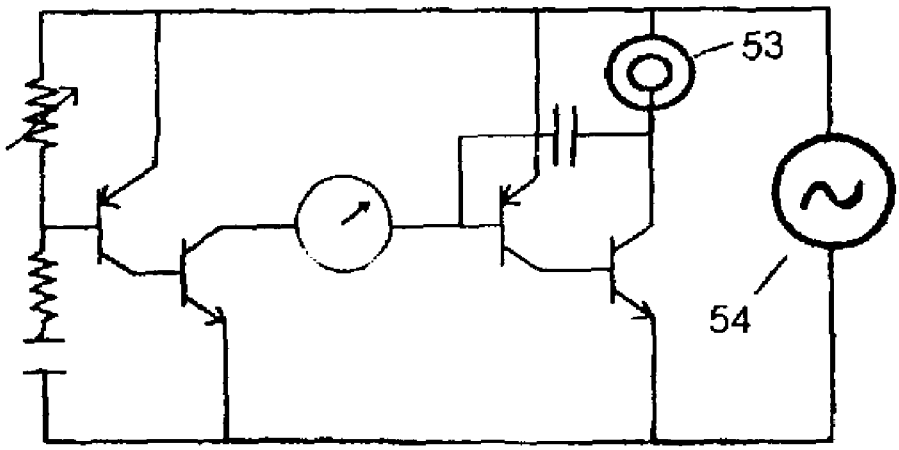

The biometric device so connected in the preferred embodiment is depicted in FIGS. 4*a* and 4*b*. The device in FIG. 4*a* is a prior art device, described in detail in the book entitled Biomeditation, by Buryl Payne and Carmen Reitano, the inventor of the current invention. This device was previously sold by Radio Shack® under the name Micronta Biofeedback Monitor, P/N 63-664.

This biometric device shown in the preferred embodiment measures skin resistance, and produces an audio signal which varies its frequency with skin resistance. It is called a relative biometric device, or RBD, because the audio output frequency is first established with the subject at a particular state, designated as the reference state, and subsequent measurements provide audio output frequencies which may be higher or lower than the frequency at the rest state.

A typical prior art RBD appears in FIG. 4*a*. In this figure, the user trims variable resistor R1 to balance the resistance of the biometric sensor R2, producing a reference tone in the loudspeaker 50. Subsequent increases or decreases in the resistance of the sensor R2 will result in changes in the reference tone, growing higher or lower in pitch to reflect this change.

Typical biometric sensors of the type described above include the Galvanic Skin Resistance (GSR) sensor, a temperature sensor, typically a thermistor, and pulse rate, typically sensed optically.

In the past the output of the relative biometric device was an audio tone, as just mentioned. In the present invention, however, the relative biometric device is modified to replace the speaker with coaxial connector 53, as shown in FIG. 4*b*. A micro-phono connector, of the type universally used in conjunction with sound cards, is the preferred type. This connector provides a means for connecting an audio signal to the sound card 6. In addition, the battery 52 of the prior art may be replaced by a power supply 54 connected to a 100 v AC utility outlet, as normally found within both residential and commercial buildings. Typically the power supply may be of the external type, which plugs into the AC outlet at one end, and provides a low dc voltage line which plugs into a device so powered.

When alternating current is present with a power supply in electronic circuits, electrical noise can become a problem. For this reason, the present invention provides an electrical isolation circuit to reduce the effect of such electrical noise. In addition, the isolator used in this invention provides a safety means to prevent potential electrical hazards from affecting the user. For instance, a short circuit or lightning strike could cause a high-voltage to be connected from the computer to the user via the sensing device. The isolation component protects the user from such hazards. It will be described further in subsequent sections of this application.

It should be noted that it is not necessary to remove the speaker from the relative biometric device when providing connections to the sound card, nor is it necessary to replace the battery power supply with an external, AC-based power supply. However, the sound card provides a means to generate an audio tone through the computer, so the speaker is not required.

The operation of the sound card is so well known and understood that it is not believed necessary to discuss it in detail.

A website that contains manuals for various sound cards is maintained by Creative Labs®, a worldwide leader in sound card technology.

Figure 7:
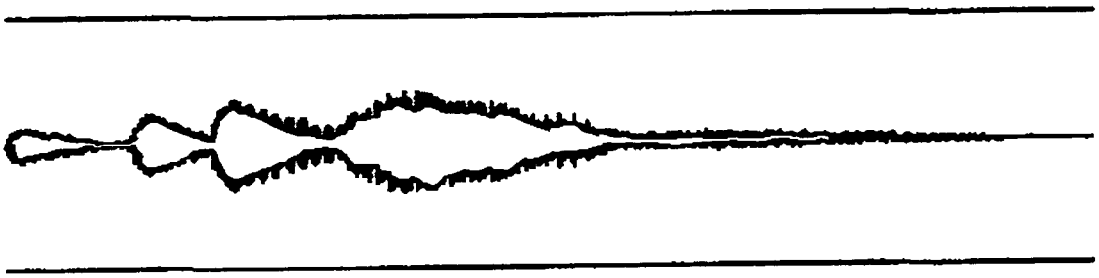
Fig. 7 Prior Art
FIG. 7 depicts a typical audio signal which has been input to a personal computer by means of a sound card, and which has been sampled and displayed by software provided by a personal computer.

When an audio signal is input to a sound card, the signal is digitally sampled at a high sampling rate, typically up to 44.1 K Hz, and each sample may be input to the computer and then stored as a record having a time of occurrence and an amplitude. FIG. 7 shows a graphic representation of the digitized data so stored from a typical sound "byte", in this case a "chime" sound used as a "sound event" by the operating system of the computer. In the graphic of FIG. 7, the sound is shown as a series of "spikes" which occur at multiples of each sampling interval, in this case, at each $1/44{,}100$ seconds, or each 22.7 microseconds, the basic sampling period. At the end of each such period the input signal may be at any value between its minimum and maximum value. However, it is well known that it is possible to reconstruct any audio signal using a sampling rate of 44.1 KHz, so that the maximum excursions of the sampled signal are determined. The period between these excursions establishes the period of the underlying audio signal, and the inverse of this period is the audio frequency, or tone.

The sound card contains provisions for directly accessing regions of the computer memory without interrupting operation of the computer by means of a DMA (Direct Memory Access) system which is a standard feature of virtually all personal computers. Thus, the digitally sampled signals over a period of several milliseconds to several seconds may be read, at intervals, into the computer memory, where it may be processed by a computer process or application.

In the present application, the audio signal is read into the sound card, sampled, and then stored in a buffer in the computer memory. The amount of memory used is selected to correspond to the interval during which a frequency is measured, and a new measurement made at each such interval, during which the previous memory is overwritten. In the present application it is contemplated that the change in frequency need be measured at an interval in the order of between tenths of a second and seconds.

The calculation of the frequency proceeds from the beginning of the buffer, and determines the number of samples between the highest value of the sampled signal and the lowest value. This calculation is repeated over the entire buffer. The number of samples between these extremes is proportional to the period of the sampled audio signal, and inversely proportional to its frequency. The frequency may vary from the beginning of the buffer to the end, or may vary as the data in the buffer is replaced by new data.

Figure 8A:
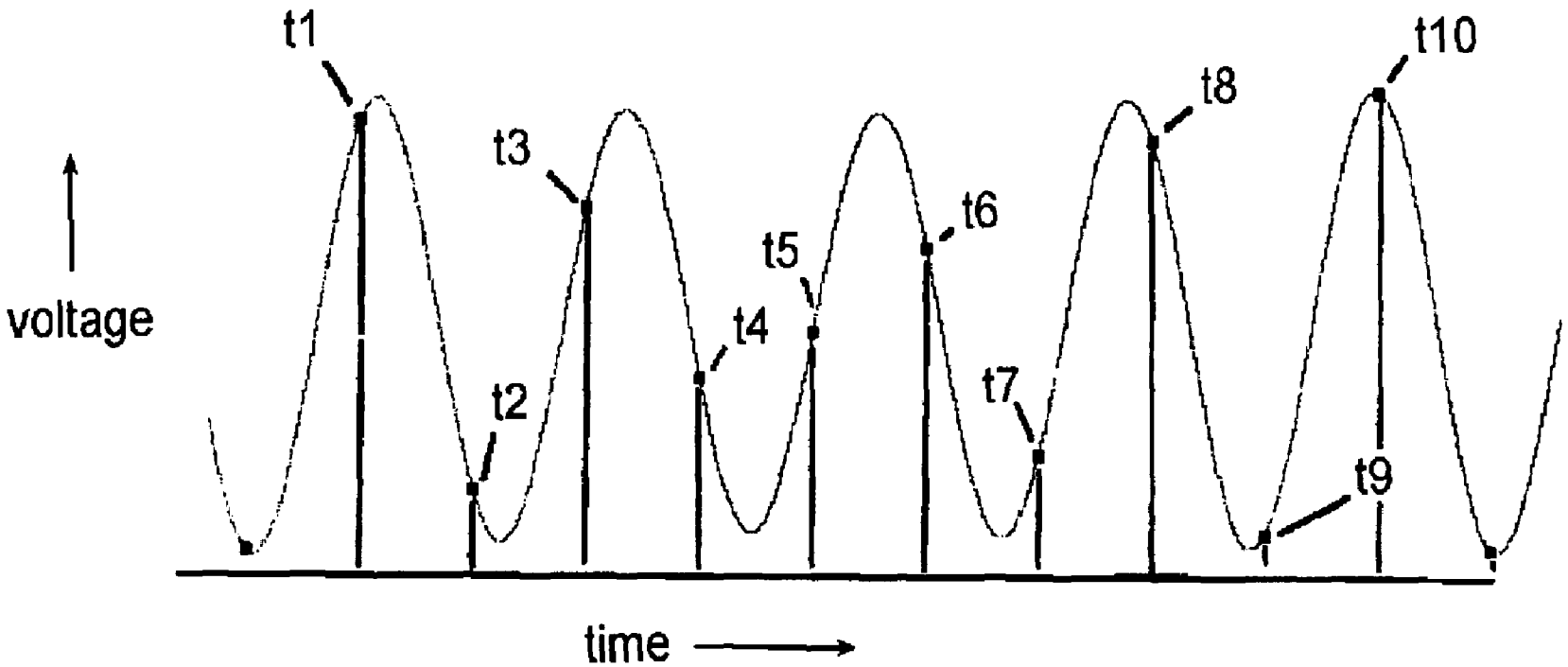
FIG. 8*a* depicts a sampled sine wave, with a sampling frequency of about twice the signal frequency.
Figure 8B:
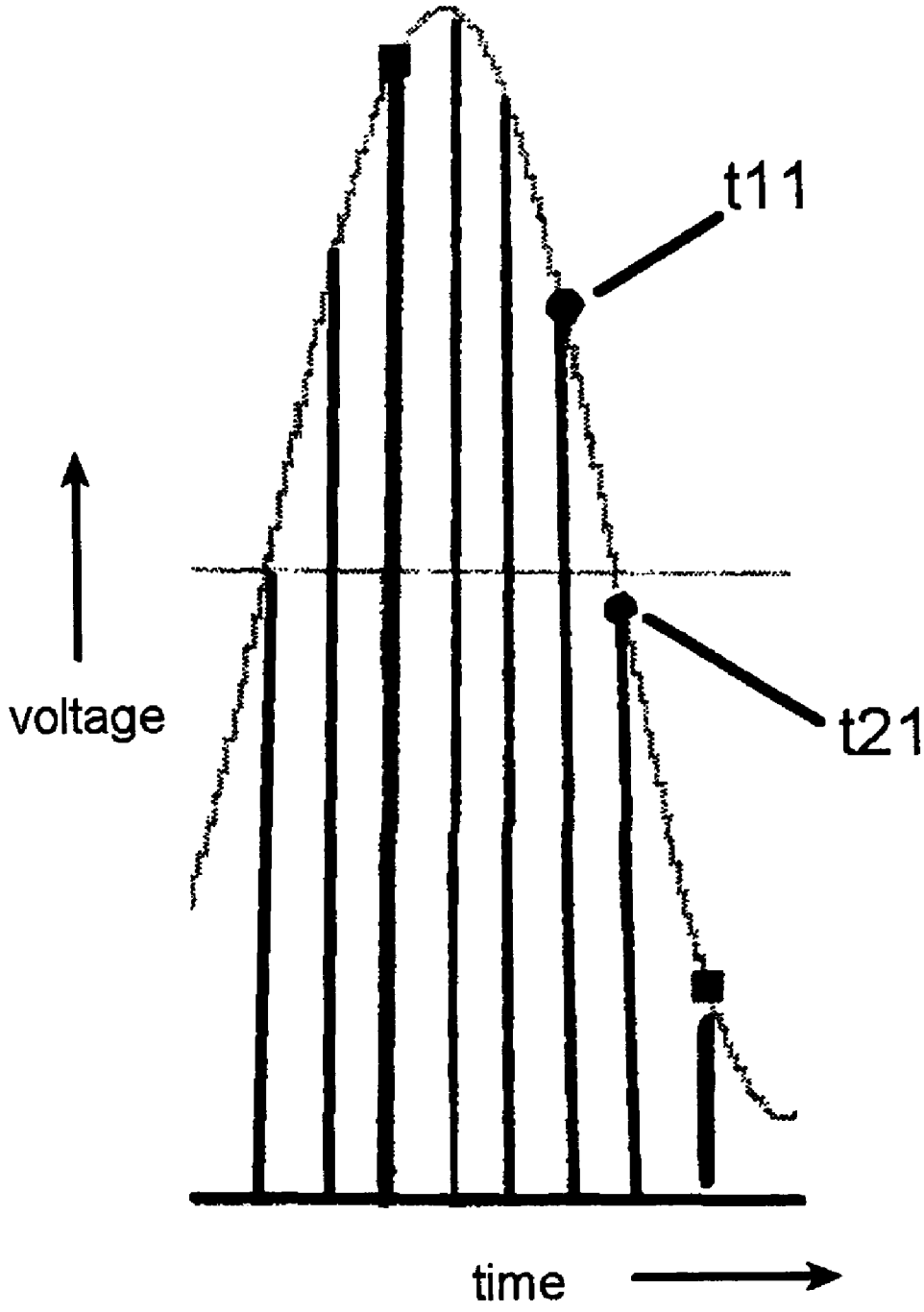
FIG. 8*b* depicts a sampled sine wave with a sampling rate of about five times the signal frequency.

FIGS. 8A and 8B show such a sampled sinusoidal signal, which corresponds to a single tone or frequency. The ordinate of this figure shows the amplitude of the signal, and the abscissa shows the sampling intervals. In this figure, the samples are taken at times t1, t2 etc. until t10. The sampling rate in this figure is close to twice the frequency of the sinusoidal signal shown, the so-called "Nyquist" frequency. This is the most difficult case, and graphically illustrates the method of determining frequency.

Note first that in FIGS. 8A and 8B the unsampled signal has an amplitude, shown on a scale at the right of the figure, which goes both positive and negative, crossing zero twice for each cycle. The amplitude A(t1) at time t1 is about 4000 units, while t2 has an amplitude A(t2) of about minus 3000 units. Thus, it is clear that a zero crossing has taken place somewhere between t1 and t2, even if only the sampled values are known. A zero crossing takes place every time the magnitudes of two adjacent sampled values are different in sign, that is, one is positive, and the other negative. The zero crossing value Azcn is thus calculated as $$Azcn=0.5*[A(tn)+A(tn+1]$$

and the time Tzc of the zero crossing is approximated as simply $$Tzcn=\tfrac{1}{2}[tn+tn+1]$$

Each time a zero crossing time Tzcn is calculated, the difference between this zero crossing time and the previous zero crossing time is calculated as $$d(Tzcn)=Tzcn-Tzc(n-1)$$

and this time difference is one-half the period of the signal. The frequency of the signal thus calculated is thus $$f=\tfrac{1}{2}*d(Tzcn)$$

It is noted that the samples do not generally occur at the highest point of the signal, nor at the lowest point. Nevertheless, the calculation will provide an accurate value of an audio frequency, so long as the sampling rate is at least 44,100 Hz, in accordance with the well-known sampling theory of Claude Shannon.

It is contemplated that the audio signals in the present application will be no greater than 5,000 Hz, since many people do not have the ability to hear sounds very much higher in frequency than this value. When the sampling rate becomes large compared to the audio signal frequency, as is generally the case in the current example, the above calculations become very precise, as can be seen in FIG. 8*b*.

In FIG. 8*b*, the sampling rate is five times that in FIG. 8*a*, and it is seen that the zero crossing, which occurs between t11 and t21, may be very accurately calculated by assuming that the sine wave approximates a straight line in the vicinity of a zero crossing, and calculating the exact time of the zero crossing accordingly.

It should be noted that the technique described herein can only be used on single-frequency audio signals. Complex signals, which possess a spectrum of different frequencies, require different techniques to measure the frequencies. The biometric instrument described herein produces only a single frequency, albeit a changing one. However the rate of change of the biometric signals is sufficiently slow that the signals may be treated as single frequency signals, as far as the techniques for determining the frequencies are concerned.

Other techniques are nonetheless available for measuring frequency, such as the use of digital filters. However, the technique described herein is simple and fast, and imposes a minimum overhead on the computer process.

Once the frequency is thus calculated, the resulting parameter, whose amplitude varies with the frequency of the sampled audio signal, is then used as the input to some computer process. A simple example is shown in FIG. 5, used in conjunction with a RBD having a temperature sensor attached to the subject's finger.

Figure 5:
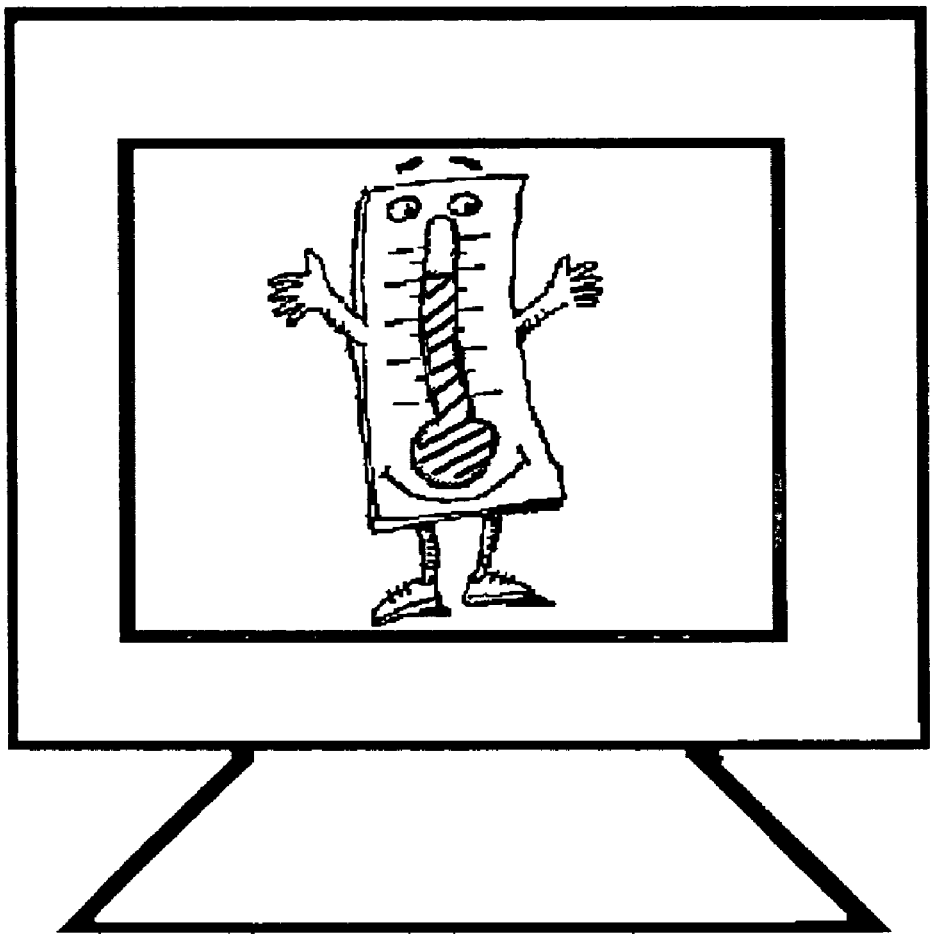
FIG. 5 depicts a graphic presentation of a biometric measurement on a computer monitor.

The thermometer displayed in FIG. 5 has a reading which varies with the frequency parameter as calculated above. As this parameter increases and decreases, the level of thermometer will rise and fall accordingly. Assuming that the biometric instrument hooked up to the sound card is a thermistor measuring the subject's temperature, the output of the biometric instrument will cause the reading of the thermometer on the computer monitor to rise and fall proportionally.

The screen depicted in FIG. 5 is also designed to display temperature relative to the subject's temperature at the time the program displaying the thermometer is started, the "startup temperature". The signal corresponding to the startup temperature will be displayed as halfway between the maximum and minimum excursion of the "mercury" in FIG. 5. Subsequent increases or decreases in the subject's temperature will produce fluctuations about this center point.

The output of the biometric instrument can also be used as a control signal in other processes, such as computer games. Such a game, which required the steering of a virtual car, for instance, could use skin resistance to drive the car to the left or to the right, or faster or slower, providing that the user could control his skin resistance through the visual feedback provided.

In more complex applications of this invention the user could be attached to two different biometric devices, each measuring a different biometric characteristic. In such an embodiment, the outputs of these signals are sent to two different sound cards, and two different outputs produced, one of which controls a first, or x parameter of a computer process, and the second a second, or y parameter of the same process. For instance, skin resistance could be used to control the x-axis position of an icon on a screen, and temperature or pulse rate to control the y-axis, position of the icon.

The Aeroisolator

Figure 2:
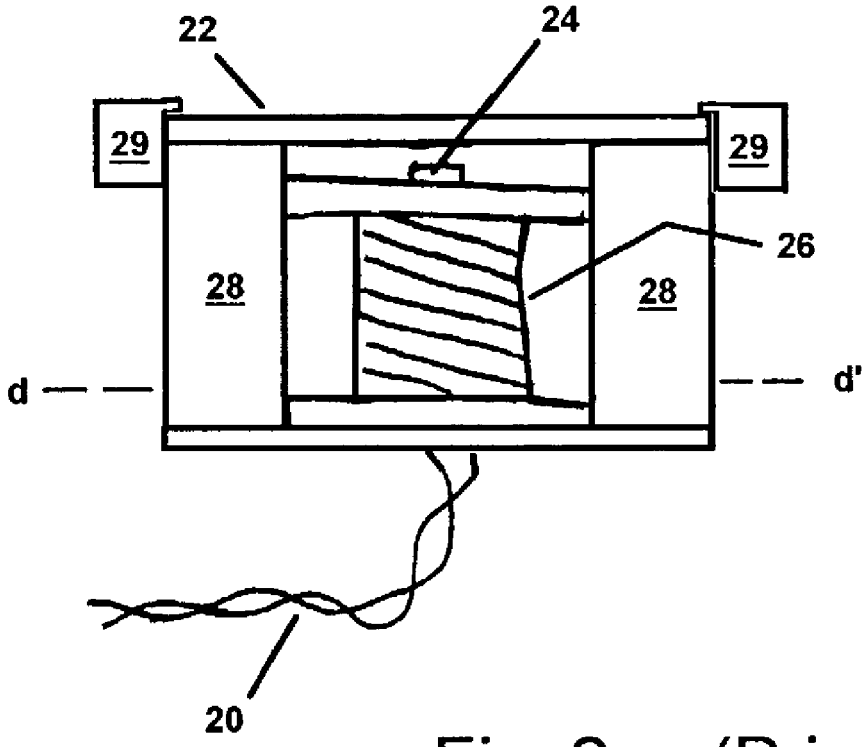
Fig. 2 (Prior Art)
FIG. 2 depicts a cross-section view of a prior art earphone.

This invention requires the use of an isolation circuit, in order to electrically isolate the subject attached to a biometric sensor from the computer to which the output signals from the biometric device are attached. In addition to the isolation circuit thus protecting the subject from possible electrical hazards, it also assists in maintain a good signal-to-noise ration, and minimizes hum inherent in the use of alternating-current-based power supplies, as described previously. The invention uses an isolation circuit which is simple and inexpensive in its design, and operative over the entire audio range of frequencies. To understand the operation of the so-called aero isolator, it is first necessary to review the prior art miniature earphone, as depicted in FIG. 2. The earphone shown is typical of a class of earphones, used for portable tape cartridge players, MP3 players, and portable radios. These earphones are often small enough so that the entire sound-producing element can fit within the ear canal of the user. Typical of such earphones is RADIO SHACK Cat. No. 33-177a, which can be used for the current application.

In its simplest form, the earphone is a type of standard loudspeaker, with the sound generated by a vibrating ferro-magnetic metal diaphragm 22, which changes its proximity to the core 24 of voice coil 26 due to the change in magnetic flux between the toroidal permanent magnet 28 and the voice coil 26, induced by the current through the voice coil which is led in through leads 20.

In the simple configuration of FIG. 2, the diaphragm is restrained by toroidal restraint 29 which prevents the diaphragm from moving more than a slight amount from its rest position.

As this type of earphone/speaker is often designed to fit into the ear canal of a wearer, the diaphragm is in the order of one-half inch in diameter, shown by the plane d–d' in FIG. 2.

It is well known in the prior art that, in a structure such as that of FIG. 2, if the ferro-magnetic diaphragm is made to vibrate by some other means, such as sound waves, the change in the magnetic flux of the toroidal permanent magnet 28 caused by the change in the distance between the diaphragm and the magnet will induce a current in the voice coil 26.

Figure 3:
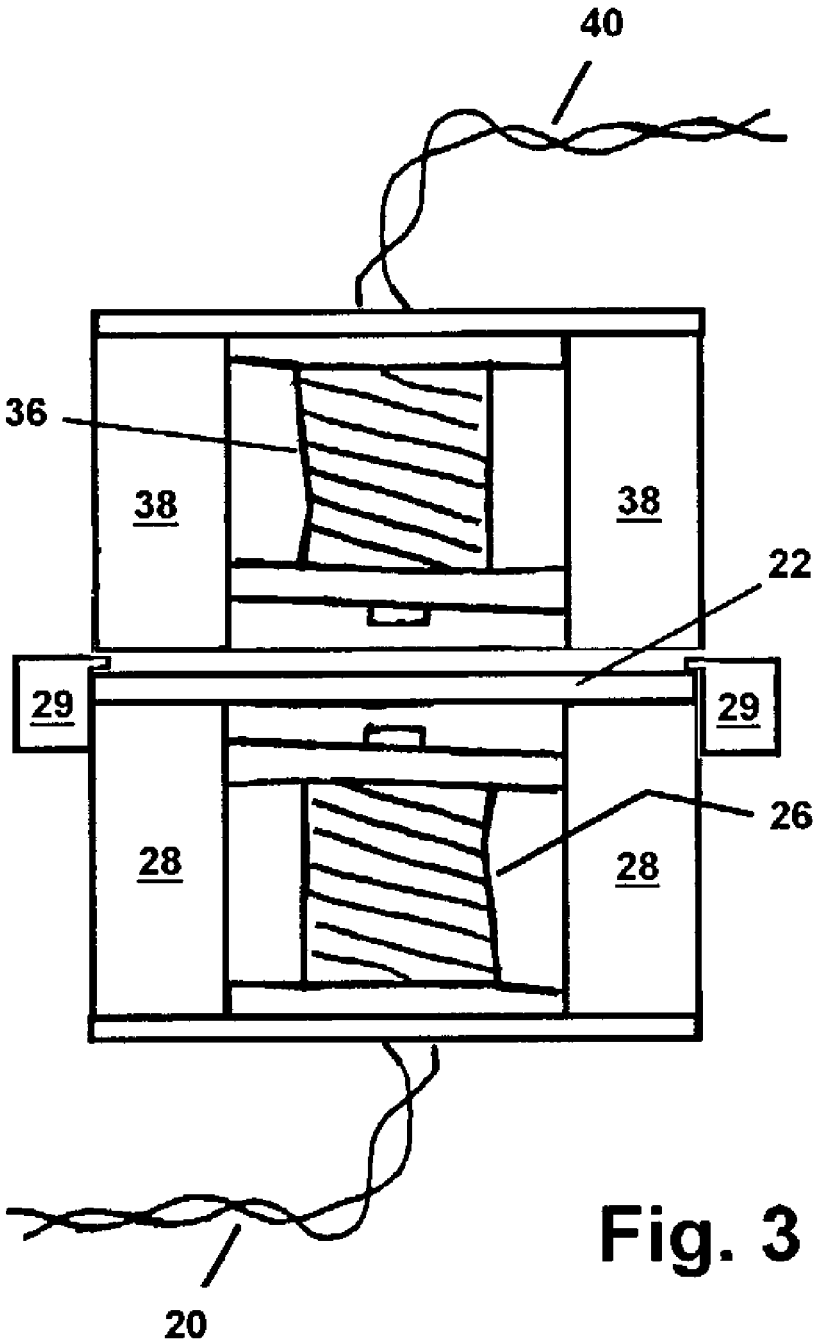
FIG. 3 depicts a cross-section view of the aeroisolator used in the preferred embodiment.

Referring next to FIG. 3, the aero isolator is shown, which combines two earphone units, one used to create the vibrations in the diaphragm when used as a loudspeaker, and the second one which induces an output current due to the vibrations in the diaphragm. A signal in lead-ins 20, induces a magnetic flux by means of voice coil 26, which interacts with the magnetic flux of toroidal permanent magnet 28, causing diaphragm 22 to vibrate. The vibrating diaphragm, in turn, induces a current in voice coil 36, and lead-ins 40.

Because there is no physical connection between the lead-in pair 20 and lead-in pair 40, the circuit shown in FIG. 3 will be found effective in the transmission of very low level signals, eliminating the noise caused when transmitting a signal from one device to another when one or more ground paths exist between the transmitting and receiving ends of a signal transmission. No such ground path exists in the case of the aeroisolator. The signal transmission takes place solely by means of a variation in a magnetic field created by transmitting signal in the voice coil of the transmitting voice call, and the current induced in the receiving end as a result of the magnetic field variations.

Other types of isolators are possible in the current application. Well-known, and mature technologies exist in the field of electrical isolation. These include optical isolators, also known as opto-isolators, and transformers.

While the invention has been described with reference to specific embodiments, it will be apparent that improvements and modifications may be made within the purview of the invention without departing from the scope of the invention defined in the appended claims.

What is claimed is:

1. A device for providing electrical isolation comprising a first and second miniature audio earphone, each further comprising:

(1) a voice coil comprising leads with two ends, wherein the leads of the first miniature audio earphone are not electrically connected to the leads of the second miniature audio earphone, (2) a permanent magnet in proximity to the voice coil, (3) a ferromagnetic diaphragm which will vibrate in response to sound waves, causing a change in a magnetic flux of the permanent magnet resulting from the change in the distance between the diaphragm and the magnet which induces a current in the voice coil, the ferromagnetic diaphragm further being caused to vibrate when the voice coil is energized, wherein the two miniature audio earphones are affixed together after the ferromagnetic diaphragm of the first miniature audio earphone has been removed, and with the ferromagnetic diaphragm of the second miniature audio earphone in close proximity to the voice coil of the first miniature audio earphone, so that when a varying electrical signal is passed through the leads of the first miniature audio earphone, the remaining ferromagnetic diaphragm is caused to vibrate, thereby inducing a current in the leads of the second miniature audio earphone.

* * * * *